United States Patent [19]

Sartor

[11] 4,291,473

[45] Sep. 29, 1981

[54] SKI BOOT DEVICE FOR FACILITATING WALKING

[75] Inventor: Mariano Sartor, Montebelluna, Italy

[73] Assignee: Nordica S.p.A., Montebelluna, Italy

[21] Appl. No.: 90,817

[22] Filed: Nov. 2, 1979

[30] Foreign Application Priority Data

Nov. 15, 1978 [IT] Italy ..... 23292/78[U]
Jun. 13, 1979 [IT] Italy ..... 21828/79[U]

[51] Int. Cl.[3] ..... A43B 5/00
[52] U.S. Cl. ..... 36/132
[58] Field of Search ..... 36/132, 117

[56] References Cited

U.S. PATENT DOCUMENTS 4,155,179 5/1979 Weninger ..... 36/132

FOREIGN PATENT DOCUMENTS 2655564 6/1978 Fed. Rep. of Germany ..... 36/132

*Primary Examiner*—Patrick D. Lawson
*Attorney, Agent, or Firm*—Guido Modiano; Albert Josif

[57] ABSTRACT

A ski boot device for facilitating walking comprises a profiled member for connection to the sole of a ski boot, and mobile from a first position in which it is flush with the plane defined by the sole to a second position in which it projects from the sole plane.

11 Claims, 9 Drawing Figures

SKI BOOT DEVICE FOR FACILITATING WALKING

BACKGROUND OF THE INVENTION

The present invention relates to a ski boot device for facilitating walking.

A ski boot generally consists of a plastics shell with a substantially rigid sole, and to which is connected a leg piece or quarter which is slightly inclined in a forward direction to the vertical axis, and which is clamped on to the user's leg.

With this ski boot configuration, the user encounters considerable difficulty in walking when wearing the boots. In this respect, during walking, the foot, or rather a part thereof, rotates about a horizontal axis in making successive steps. As the boots have a substantially rigid sole, this possibility of rotating part of the foot relative to the ground is prevented in practice, and consequently in order to be able to walk, the user has to make unnatural movements which are extremely uncomfortable.

Moreover, as that part of the leg piece engaged with the leg portion at the ankle is inclined forwards, the user encounters difficulty in remaining in an upright position, as the lower part of the leg has necessarily to assume the inclination imposed by the leg piece.

SUMMARY OF THE INVENTION

The object of the present invention is to obviate the aforesaid drawbacks by providing a device which makes it easier to walk when wearing the ski boots, and which also makes it possible for the user to remain in an upright position by maintaining the lower part of the leg vertical, this being the most natural and consequently most restful position.

A further object of the invention is to provide a device which does not obstruct the fixing of the boot to the ski connections, and which is also of extremely simple and rapid operation.

A further object of the present invention is to provide a device of extremely simple structure, with which reliability and safety are completely ensured.

A further object of the present invention is to provide a device which is easily constructed from components easily available commercially, and which is highly competitive from a cost aspect.

These and further objects which will be more apparent hereinafter are attained by a ski boot device for facilitating walking according to the invention characterized in that it comprises a profiled member for connection to the sole of a ski boot, said profiled member being mobile from a first position in which it is in line with the plane defined by said sole, to a second position in which it at least partly projects beyond the plane defined by said sole, and/or vice versa.

BRIEF DESCRIPTION OF THE DRAWINGS

Further characteristics and advantages will be more apparent from the detailed description of two embodiments of a ski boot device according to the invention, illustrated by way of non-limiting example in the accompanying drawings in which.

DESCRIPTION OF THE PREFERRED EMBODIMENTS

Figure 1:
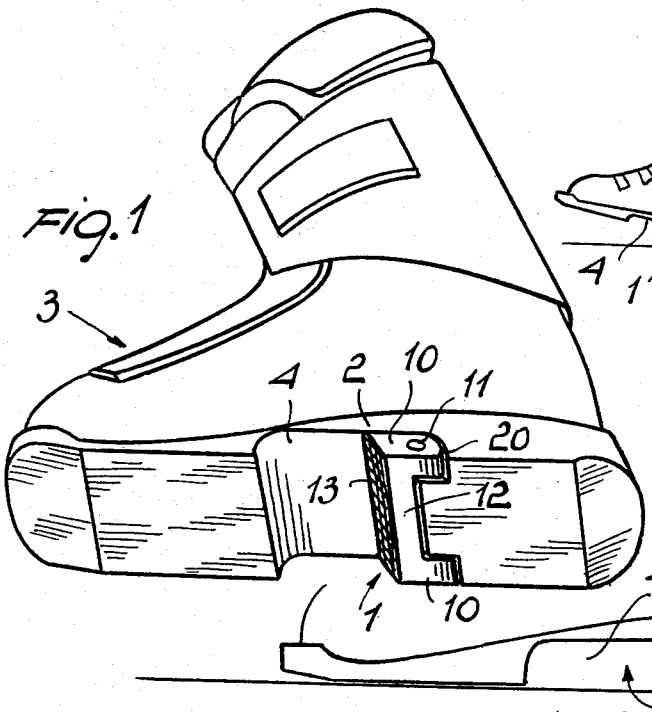
FIG. 1 is a perspective diagrammatic view of a ski boot with a device according to a first embodiment of the invention in said first position.
Figure 5:
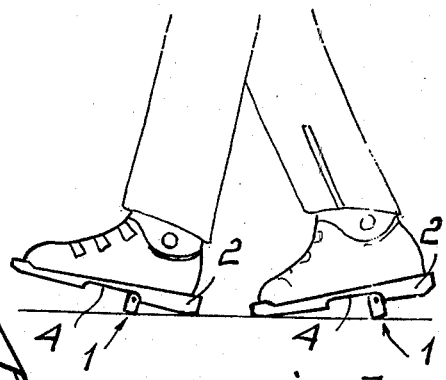
FIGS. 5 and 6 are diagrams showing the use of the device in facilitating walking and for allowing an upright position to be maintained.
Figure 2:
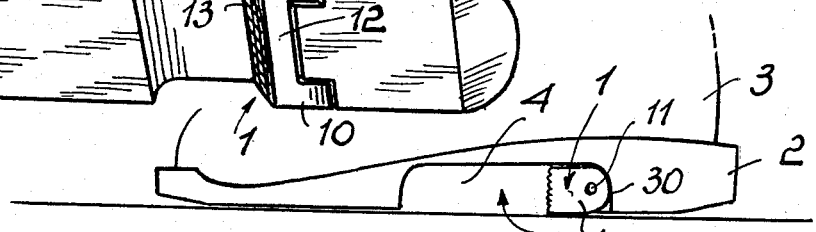
FIG. 2 is a side view of the ski boot and device in said first position.
Figure 3:
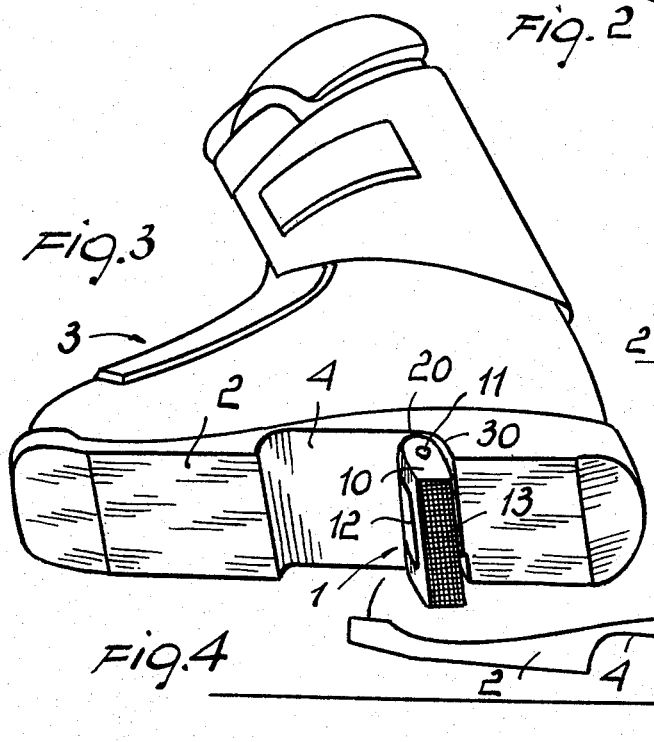
FIG. 3 is the same perspective view of a ski boot and device in said second position.
Figure 6:
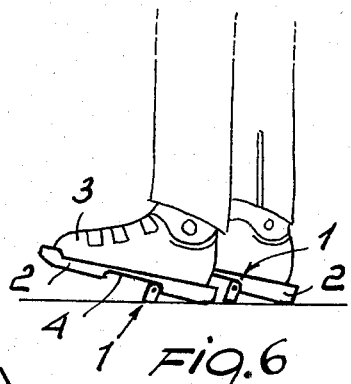
Figure 4:
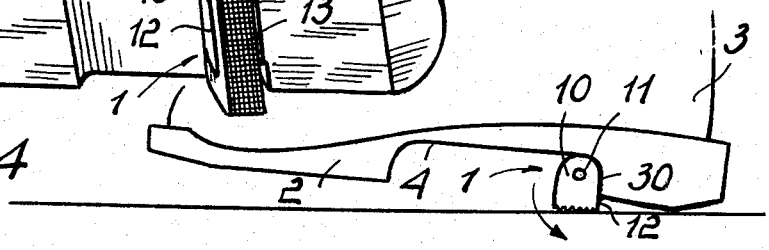
FIG. 4 is a side view of the ski boot and device in said second position.

With reference to FIGS. 1 to 6, a ski boot device according to the invention comprises in a first embodiment a profiled or shaped member constituted by a stirrup element and indicated overall by 1, which is provided in a central portion of the sole 2 of a boot 3, namely in the instep zone or seat 4 located between the front portion of the sole 2 and the heel portion of the sole 2.

The stirrup element 1 is substantially of widened U configuration, and has the free ends of its arm 10 pivoted at a pin 11 which extends parallel to the bottom plane defined by the sole, and substantially perpendicular to the longitudinal development of the sole. As visible particularly in FIG. 1, the heel portion of the sole has an appendix projecting into the instep seat 4, while the free ends of the arms 10 of the stirrup element 1 are pivotally connected to said appendix because of the fact that pin 11 extends through the appendix. From FIG. 1 it is further visible that both the stirrup element 1 and the sole 2 have an equal width.

Roughening or knurling 13 is provided on the outside of the portion 12 joining the arms 10, in order to increase friction in the manner which will be described hereinafter.

The said stirrup element 1 is mobile from a first position (shown in FIGS. 1 and 2) in which it is turned into the instep zone 4 of the sole 2 and is thus substantially in line with the bottom plane defined by the sole 2 without projecting beyond the sole, to a second position shown in FIGS. 3 to 6 in which the stirrup element, namely the joining portion 12, projects below the bottom plane of the sole.

In addition, the free ends of the arms 10 are rounded and are of cam configuration 20, such that the said first and second position are positions of stable equilibrium, i.e. the cam configuration 20 when co-operating with the instep seat walls overcomes the slight resilience of the material with which both the sole 2 and the stirrup element 1 are made, so that the stirrup element becomes resiliently urged towards the first or second position.

In the second position, the roughening or knurling 13 rests of the ground to act as a fulcrum for the support on the ground. In this position, the stirrup element is substantially rotated through about 90° from its initial position, and the force exerted on it during walking or when maintaining an upright position is such as to force it or maintain it in contact against the stop 30, defined on the heel portion of the sole 2.

The structure of the stirrup element 1 and the presence of the knurling 13 considerably increase the friction between the boot and the ground, so preventing slipping and consequently facilitating walking.

The described device according to the invention is used as follows. When the stirrup element 1 is in its second position, i.e. projecting beyond the sole, it acts as a fulcrum zone for the rotation of the foot during walking. In this respect, as illustrated diagrammatically in FIG. 5, during walking, the boot rests on the ground by way of the stirrup element 1 and by way of the heel or toe, so as to allow an albeit limited rotation of the foot about a horizontal axis, this rotation being extremely useful in facilitating walking.

In addition, in the rest or upright position of the user, the weight exerted by the user on the boot acts at a point lying between the stirrup element 1 and the rear of the sole, such that the boot becomes supported between the rear of the heel and the stirrup element with the toe raised upwards. Under these conditions, any forward inclination of the leg portion relative to the boot shell is practically annulled, so that the user's legs become disposed along a vertical axis, so giving a more natural and comfortable position when at rest.

Figure 7:
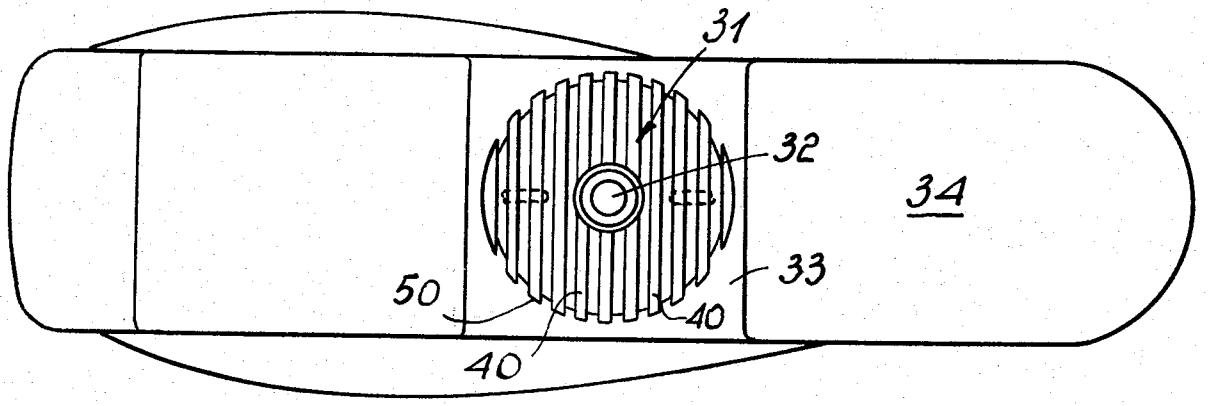
FIG. 7 shows a second embodiment of the a ski boot device according to the invention, fitted to the sole of a ski boot.
Figure 8:
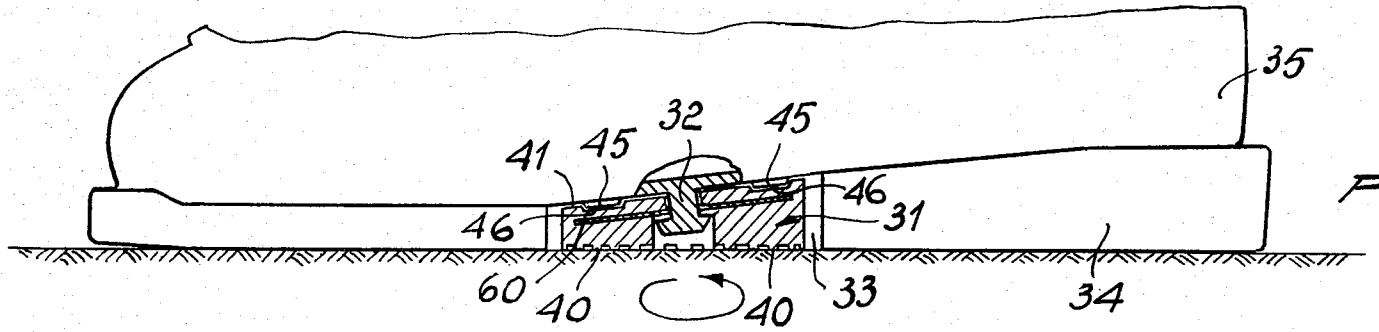
FIG. 8 is a section through the device of FIG. 7 in said first position.
Figure 9:
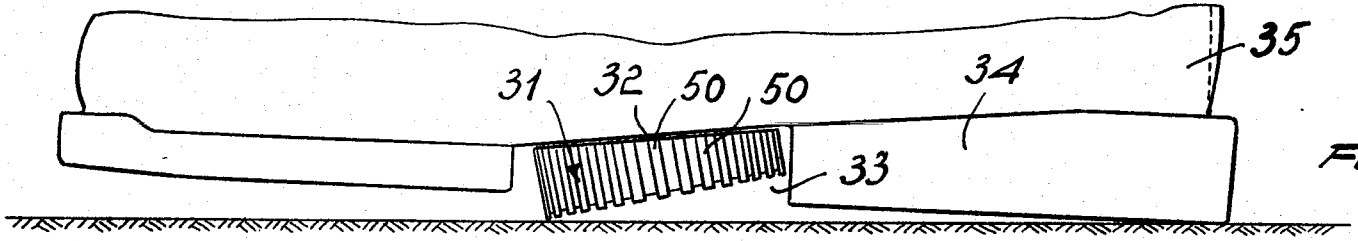
FIG. 9 shows the device of FIG. 7 in said second position.

According to a further embodiment shown in FIGS. 7 to 9, the ski boot device for facilitating walking comprises a profiled member constituted by a substantially cylindrical element indicated overall by the reference numeral 31, which can be rotatably connected to a pin 32 provided at the base of a seat 33 formed between the front portion and the heel portion of the sole 34 of a ski boot indicated by 35, but not completely shown in FIGS. 7 to 9.

Said cylindrical element 31 is thus rotatable about an axis defined by pin 32 which substantially perpendicular to the base of said seat 33.

The cylindrical element 31 has a lower face which is provided with transverse scoring 40, the purpose of which will be explained hereinafter, and which lies perpendicular to the geometric axis of the cylindrical element, and an upper face 41 which is inclined with respect to the axis of the cylindrical element, this inclination being conjugate with the inclination of the base of the seat 33.

The cylindrical element 31, which is idly rotatable about the pin 32, can be selectively positioned in a first position (FIG. 8) in which its lower face is substantially in line or flush with the sole 34, or a second position (FIG. 9), in which at least part of the cylindrical element 31 projects beyond the sole so as to act as a fulcrum for the rotation of the boot about the front edge of the cylindrical element 31 projecting from the sole 34, to facilitate walking.

These two positions can be obtained simply by rotating the cylindrical element 31 through 180° about the pin 32, utilising the fact that the upper face of the cylindrical element 31 is inclined so that when it is in contact with the inclined base of the seat 33, the cylindrical element is either in line with the sole or projects beyond it.

The device according to the embodiment of FIGS. 7 to 9 also comprises means for maintaining said cylindrical element 31 in said first or second position, said means being constituted by a pair of projections 45 provided on the base of the seat 33 diametrically opposite with respect to the pin 32. Two diametrically opposed cavities 46 provided correspondingly in the upper face of the element 31 engage with said projections 45 in such a manner as to enable the element 31 to be rotated and locked in two positions angularly spaced by 180°, these positions corresponding to the first and second position as already stated.

Advantageously, the seat 33 is open laterally to give easy access to the cylindrical element 31 by the user, and the lateral surface of the cylindrical element 31 is provided with projecting ribs 50 which facilitate its gripping, said ribs 50 being in practice an extension to the scoring 40, the purpose of which is to act as a friction element for the grip between the cylindrical element 31 and the ground.

In addition, inside the cylindrical element 31, which preferably but not necessarily is of synthetic plastics construction, there is embedded a metal disc 60 for stiffening the structure.

The use of the device according to the invention is extremely simple, and in this respect when the device is positioned as in FIG. 8 it does not project beyond the sole and therefore constitutes no obstacle to connecting the boot to the ski, whereas when it is positioned as in FIG. 9, its front end projects beyond the sole so as to act as a fulcrum for the rotation of the boot, and consequently of the foot, about the support zone between the cylindrical element 31 and the ground.

From the description, it can be seen that the invention attains the proposed objects, in that the addition of a structurally simple element, as is the stirrup element 1 or cylindrical element 31, enables the foot to rotate during walking, so allowing a greater freedom of movement, and the element itself is of no obstacle during skiing in that in its first position it is folded or rotated into the instep of the boot, so that it is perfectly in line with the sole.

In practice, although the best results are obtained using plastics, the materials used and the dimensions can be chosen at will according to requirements.

I claim:

1. A ski boot device for facilitating walking, comprising a profiled member for connection to a sole of a ski boot at an instep seat located between a front portion of said sole and a heel portion of said sole, said profiled member being mobile between a first position in which it is in line with a bottom plane of said sole, and a second position in which it at least partly projects beyond said bottom plane of said sole, wherein said heel portion of said sole has an appendix projecting into said instep seat and said profiled member comprises a stirrup element having a widened U-configuration and two arms having free ends pivotally connected to said appendix for rotation about an axis substantially parallel to said bottom plane of said sole and perpendicular to said appendix, and wherein said stirrup element and said sole have an equal width.

2. A ski boot device as claimed in claim 1, wherein said free ends of said arms of said stirrup element have a cam configuration for co-operation with said instep seat such that said first and second position define stable positions for said stirrup element.

3. A ski boot device for facilitating walking, comprising a profiled member for connection to a sole of a ski boot between a front portion of said sole and a heel portion of said sole, wherein said profiled member comprises a substantially cylindrical element housed in a seat provided in said sole between said front portion and said heel portion and rotatable about a pin substantially perpendicular to a base of said seat, said cylindrical element having a geometric axis and a lower face substantially perpendicular to said geometric axis and an upper face inclined with respect to said geometric axis, said cylindrical element being selectively positionable in a first position in which said lower face is in line with said sole, and in a second position in which at least a part of said cylindrical element projects beyond said sole.

4. A ski boot device as claimed in claim 3, wherein said base of said seat has an inclination conjugate with the inclination of said inclined upper face.

5. A ski boot device as claimed in claim 3, further comprising means for selectively maintaining said cylindrical element in said first and second position, said means comprising projections on said base of said seat diametrically opposite with respect to said pin and cavities correspondingly provided in said upper face of said cylindrical element for receiving said projections.

6. A ski boot device as claimed in claim 3, wherein said first and said second position of said cylindrical element are angularly spaced by 180° about said pin.

7. A ski boot device as claimed in claim 3, wherein said cylindrical element comprises scoring on said lower face to act as a friction element.

8. A ski boot device as claimed in claim 3, wherein said seat is open laterally to facilitate access to said cylindrical element.

9. A ski boot device as claimed in claim 3, wherein said cylindrical element comprises a lateral face and ribs on said lateral face to facilitate gripping of said cylindrical element.

10. A ski boot device as claimed in claim 3, further comprising a metal stiffening disc embedded into said cylindrical element.

11. A ski boot device as claimed in claim 3, wherein said cylindrical element and said pin are arranged on said sole in a position such that when the user's body is in an upright position, the user's weight acts at a point lying between said cylindrical element and a rear end of said heel portion of said sole.

* * * * *